US005649866A

United States Patent [19]

Balwanz

[11] Patent Number: 5,649,866

[45] Date of Patent: Jul. 22, 1997

[54] AMUSEMENT RIDE SYSTEM

[76] Inventor: C. Grant Balwanz, 229 Golden Rod Dr., Seymour, Tenn. 37865

[21] Appl. No.: 624,939

[22] Filed: Mar. 22, 1996

[51] Int. Cl.[6] ..... A63G 31/08

[52] U.S. Cl. ..... 472/118; 472/49

[58] Field of Search ..... 472/49, 50, 136, 472/137, 133, 118, 125, 131

[56] References Cited

U.S. PATENT DOCUMENTS

| | | | |
|---|---|---|---|
| 5,094,448 | 3/1992 | Hackett . | |
| 5,267,906 | 12/1993 | Kitchen et al. . | |
| 5,421,783 | 6/1995 | Kockelman et al. . | |
| 5,527,223 | 6/1996 | Kitchen et al. | 472/131 X |

*Primary Examiner*—Kien T. Nguyen
*Attorney, Agent, or Firm*—Michael E. McKee

[57] ABSTRACT

An amusement ride system includes a chair assembly within which an occupant is seated during the course of a ride and first, second and third upstanding towers fixedly secured to the ground in a spaced and triangular relationship. A first pair of bungee cords are joined to one side of the chair assembly and have ends which extend toward the upper portion of the first tower, and a second pair of bungee cords are joined to the opposite side of the chair assembly and have ends which extend toward the upper portion of the second tower, and a windable cable which is joined to each of the extending ends of the first and second pair of bungee cords for tensioning the bungee cords to a stretched condition. A pull cable is releasably joined to the back of the chair assembly for tensioning the pull cable by way of the upper portion of the third tower as the bungee cords are being pulled to the stretched condition so the chair assembly is lifted from the ground by the bungee cords and the pull cable to a position adjacent the upper portion of the third tower. By releasing the cable from the back of the chair assembly when the chair assembly is positioned adjacent the upper portion of the third tower as aforedescribed, the first and second pairs of bungee cords are permitted to throw the chair assembly along a substantially horizontal path extending from the third tower and between the first and second towers.

15 Claims, 6 Drawing Sheets

AMUSEMENT RIDE SYSTEM

BACKGROUND OF THE INVENTION

This invention relates generally to amusement ride systems and relates, more specifically, to such systems which throw individuals through the air.

Amusement rides are known which employ bungee cords for throwing individuals through the air and for supporting the individual during a following period during which the individual oscillates in a bouncing motion until he stops. One such apparatus is shown and described in U.S. Pat. No. 5,421,783 and utilizes two or three spaced-apart and elevated supports, a seat positioned generally between the supports, and bungee cords which extend between the supports and the seat. To use the ride, the seat is initially secured to the ground and then the bungee cords are pulled to a stretched condition. The seat is subsequently released from its secured condition at the ground so that the seat (and an individual seated therein) is thrown by the bungee cords along a substantially vertical path.

It is an object of the present invention to provide a new and improved amusement ride system which employs bungee cords for throwing an individual through the air.

Another object of the present invention is to provide such an amusement ride system which, during use, throws an individual along a non-vertical path.

Still another object of the present invention is to provide such an amusement ride system which, during use, throws an individual along a substantially horizontal path.

Yet another object of the present invention is to provide such an amusement ride system which is uncomplicated in construction yet effective in operation.

SUMMARY OF THE INVENTION

This invention resides in an amusement ride system including means providing first, second and third elevated supports arranged in a spaced and substantially triangular relationship and a chair assembly arranged between the towers for supporting an individual during the course of a ride. The system also includes first and second bungee cord means having two opposite ends wherein one end of the first bungee cord means is joined to the chair assembly and wherein one end of the second bungee cord means is joined to the chair assembly. Means are associated with the first and second elevated supports for pulling upon the ends of the first and second bungee cord means opposite the ends thereof to which the first and second bungee cord means are joined for tensioning the first and second bungee cord means to a stretched condition.

The system further includes a pull cable releasably joined to the chair assembly and means for tensioning the pull cable between the chair assembly and the third elevated support so that by pulling the first and second bungee cord means to a stretched condition and tensioning the pull cable, the chair assembly is lifted by the bungee cord means and the pull cable toward a preselected position between the elevated supports at which the first bungee cord means are arranged in a stretched condition between the chair assembly and the first elevated support and the second bungee cord means are arranged in a stretched condition between the chair assembly and the second elevated support. Means are also provided for releasing the pull cable from the chair assembly when the chair assembly is positioned in the preselected position so that the first and second bungee cord means are permitted to throw the chair assembly along a path extending from the third elevated support and between the first and second elevated supports.

DETAILED DESCRIPTION OF AN ILLUSTRATIVE EMBODIMENT

Figure 1:
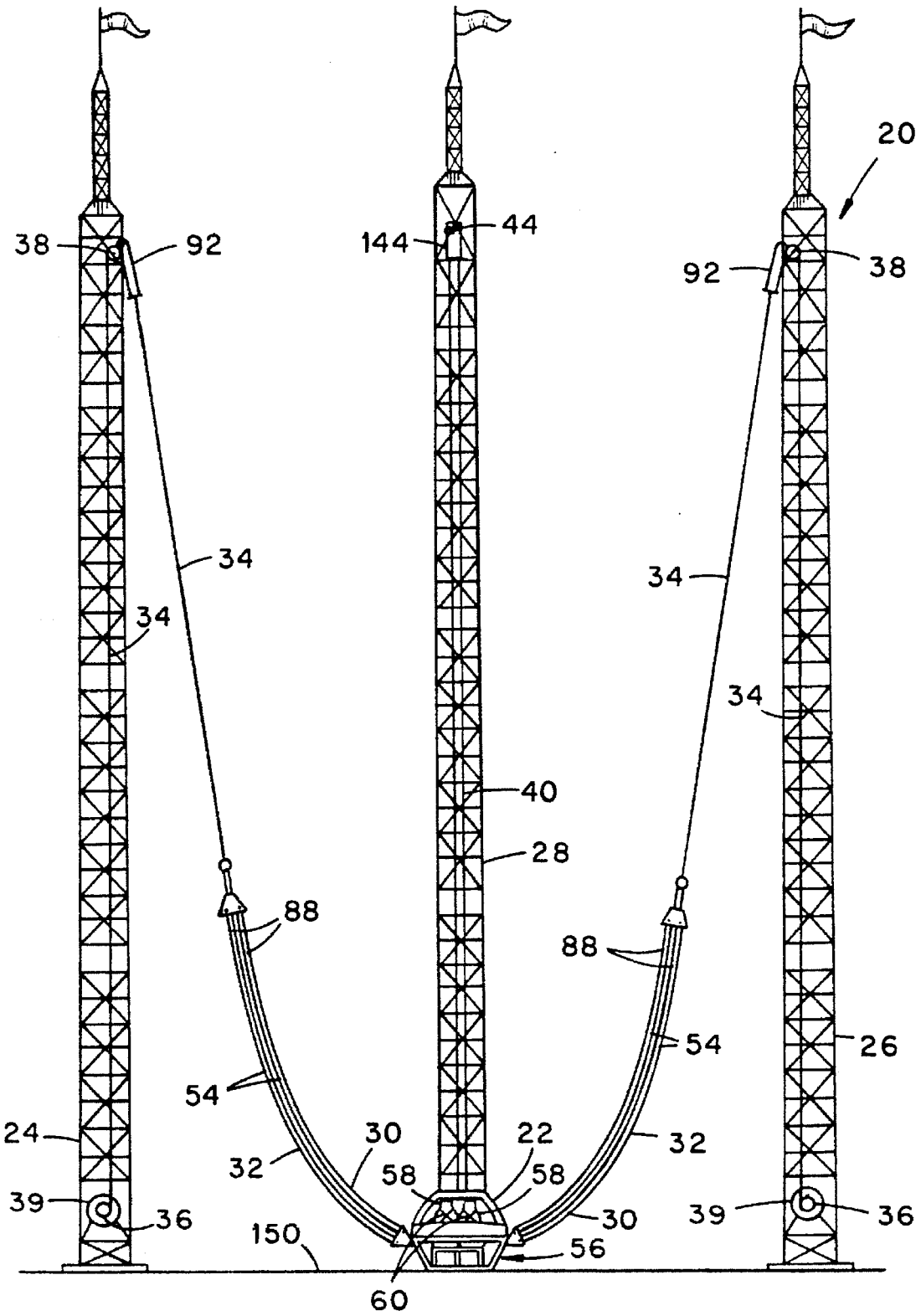
FIG. 1 is a front elevational view of an amusement ride system within which features of the present invention are embodied and wherein a chair assembly thereof is situated at a loading zone of the system.
Figure 2:
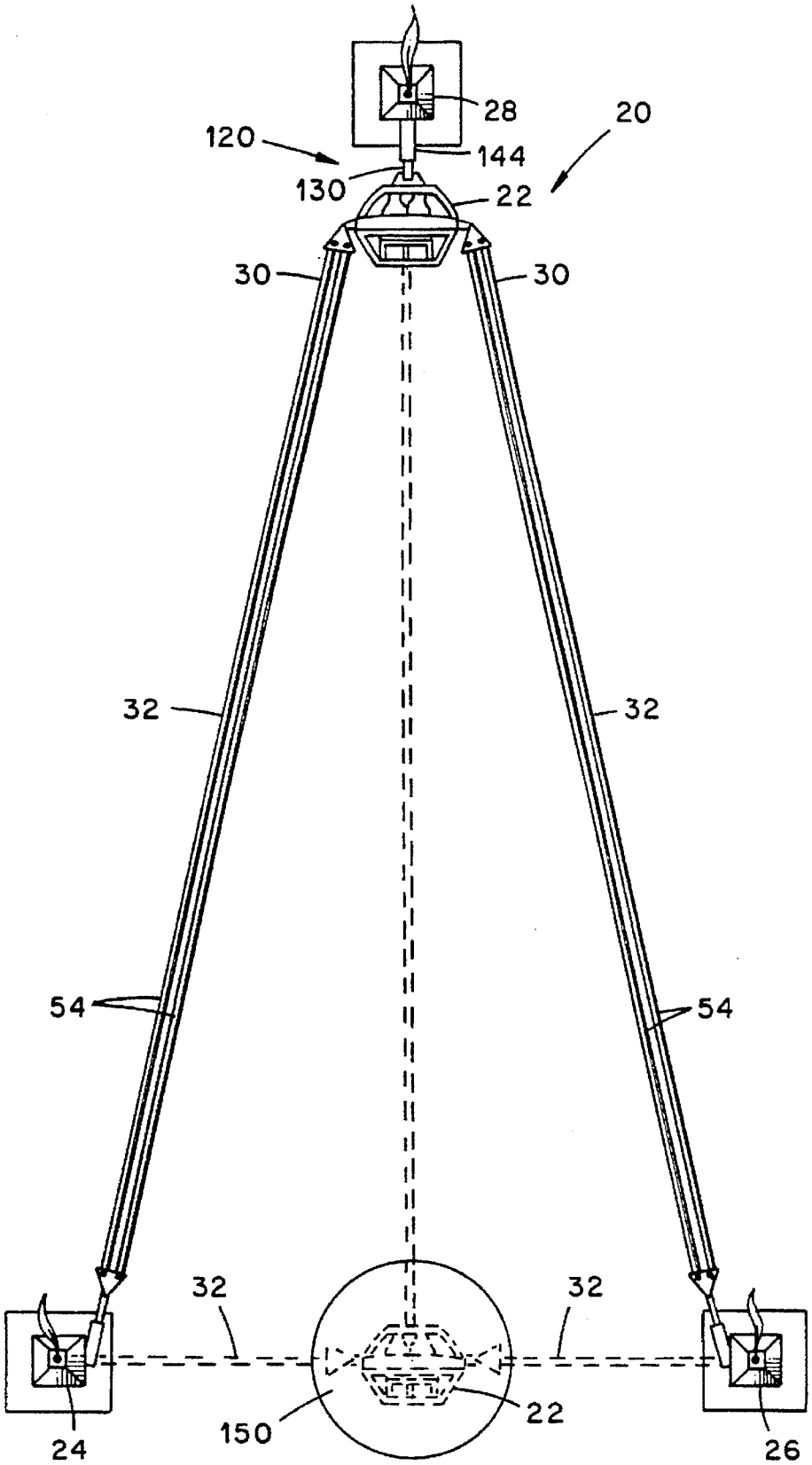
FIG. 2 is a plan view of the FIG. 1 system as seen generally from above in FIG. 1 and wherein the chair assembly thereof is positioned adjacent the upper portion of one of the towers of the system in preparation of a release of the chair assembly through the air.
Figure 3:
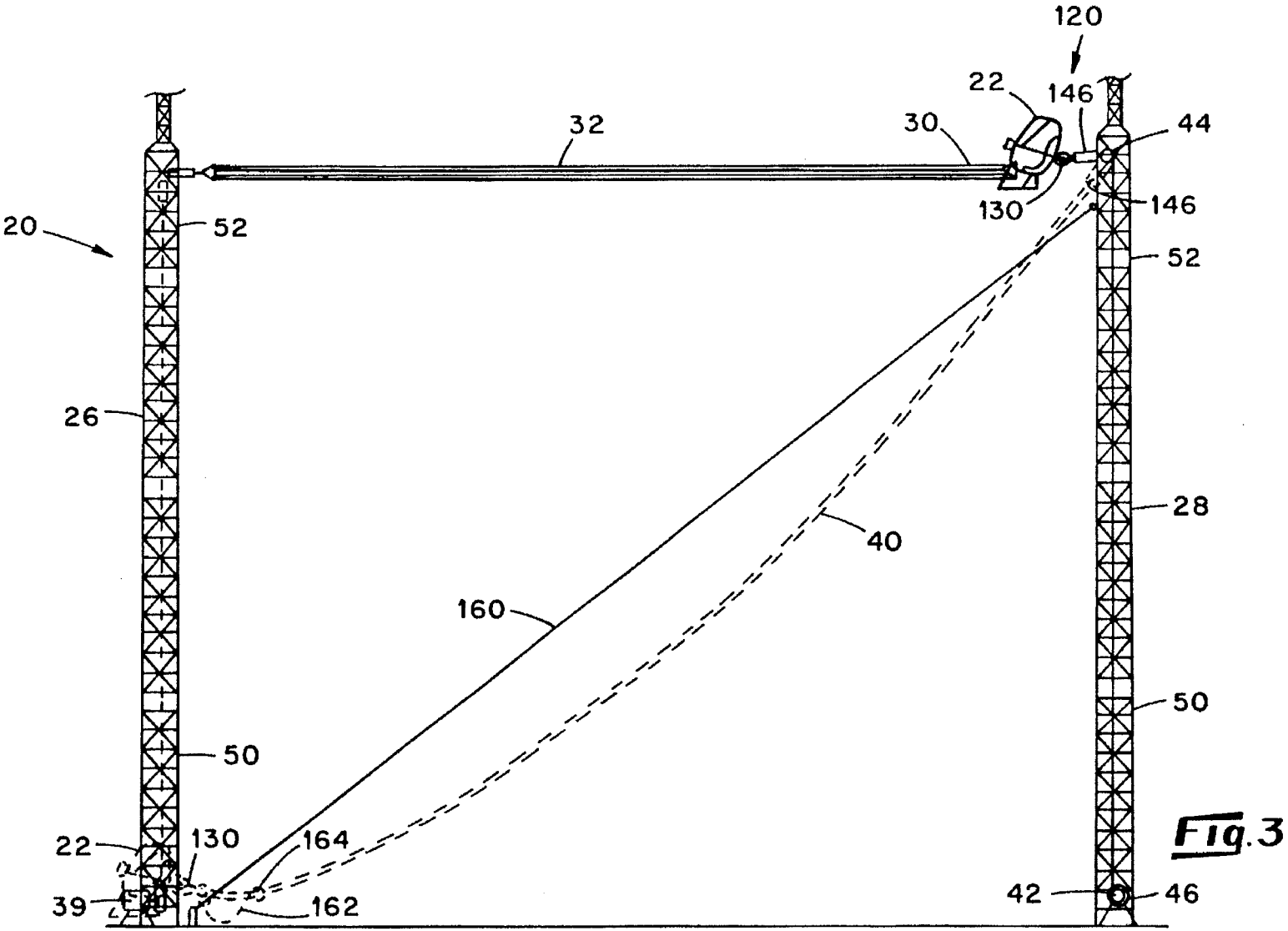
FIG. 3 is a side elevational view of the FIG. 1 system as seen generally from the right in FIG. 1 and wherein the chair assembly thereof is positioned in its position illustrated in FIG. 2.

Turning now to the drawings in greater detail, there is shown in FIGS. 1–3 an embodiment, generally indicated 20, of an amusement ride system for throwing, or slinging, an individual through the air during operation of the system 20. In this connection, the amusement ride system 20 includes a chair assembly 22 within which an individual is seated and secured during the course of a ride and three upstanding, stationary towers 24, 26 and 28 between which the chair assembly 22 is positioned. Joined to each side of the chair assembly 22, in a manner described in greater detail herein, is one end, indicated 30, of bungee cord means 32, and the other, opposite end of the bungee cord means 32 is joined to a tensioning cable 34. The tensioning cable 34 is, in turn, connected to a rotatable spool 36 mounted adjacent the base of a corresponding tower 24 or 26 by way of a pulley 38 secured adjacent the upper end of the corresponding tower 24 or 26. An electric motor 39 is drivingly connected to the spool 36 so that upon actuation of the motor 39, the cable 34 is wound about the spool 36 to tension the bungee cord means 32 disposed on each side of the chair assembly 22 to a stretched condition.

Releasably joined to the back of the chair assembly 22 is another cable, i.e. a pull cable 40, which extends from the chair assembly 22 to a rotatable spool 42 mounted adjacent the base of the third tower 28 by way of a pulley 44 secured adjacent the upper end of the third tower 28. An electric motor 46 is drivingly connected to the spool 42 so that upon actuation of the motor 46, the cable 40 is wound about the spool 42 and pulls the chair assembly 22 to a position disposed adjacent the upper end of the third tower 28, as best shown in FIGS. 2 and 3. During the initial moments of operation of the ride system 20, the motors 30 and 39 are actuated simultaneously so that the bungee cord means 32 are tensioned to a stretched condition while the chair assembly 22 is being pulled to an elevated position adjacent the upper end of the tower 28. Therefore, when the chair assembly 22 reaches the desired elevated position adjacent the third tower 28, the bungee cord means 32 are stretched to an elongated condition. Upon thereafter releasing the cable 40 from the chair assembly 22, the bungee cord means 32 are permitted to throw the chair assembly 22 and the individual secured therein along a substantially horizontal path extending generally from the third tower 28 and between the first and second towers 26, 28. The chair assembly 22 is thereafter permitted to oscillate in a bounding motion toward and away from the third tower 28 until the bungee cord means 32 (which remain secured to the chair assembly 22) attain a condition of equilibrium, or rest.

With reference still to FIGS. 1 and 3, each upstanding tower 24, 26 or 28 includes a steel framework having a lower end 50 which is anchored within the ground and an upper end 52 which extends an appreciable distance above the ground. As will be apparent herein, the upper end of the framework provides an elevated support for the cable pulley 38 or 44, introduced above. In addition, the towers 24, 26 and 28 are situated relative to one another in a triangular relationship. In other words and with reference to FIG. 2, imaginary lines drawn between the lower ends 50 of the towers 24, 26, 28 or more particularly, the ground locations at which the towers 24, 26 or 28 are anchored, form an equilateral triangle wherein the distance between the first and third towers 24 and 28 is substantially equal to the distance between the second and third towers 26 and 28. As will be apparent herein, this triangular arrangement of the towers promotes the throwing of the chair assembly 22 from the third tower 28 along a path which is generally perpendicular to a line extending between the first and second towers 24 and 26 and which intersects the line generally midway along its length.

With reference still to FIG. 1, the chair assembly 22 includes a cage 56 comprised of a plurality of steel tubes which are welded together to form a cage-like protective frame within which a pair of seats 58 are secured. The chair assembly 22 is arranged between the towers 24, 26, 28 so that the first and second towers 24, 26 are disposed to opposite sides of the chair assembly 22 while the back of the chair assembly 22 generally faces the third tower 28. Associated with each seat 58 is a five-point harness assembly 60 for securing an individual within the seat 58 when an individual is seated therein. For a more detailed description of the structure of the cage 56, seats 58 and harness assemblies 60, reference can be had to co-pending application entitled CHAIR ASSEMBLY FOR AN AMUSEMENT RIDE, filed Feb. 29, 1996 and having the same inventor as the instant application, the disclosure of which is incorporated herein by reference.

It is a feature of the system 20 that each of its bungee cord means 32 includes two bungee cords 54 which extend between a corresponding side of the cage 56 and a corresponding tensioning cable 34. Because two bungee cords 54, rather than a single bungee cord, are attached to each side of the cage 56, the diameter of the cords 54 can be smaller than that of a single cord to provide the same degree of elasticity as is commonly provided in a single cord having a larger diameter. By way of example, each bungee cord 54 has a diameter of about 2.0 inches and an undeformed (i.e., relaxed) length of about 22.0 feet. Furthermore, two bungee cords 54 disposed on each side of the cage 56 enhance the safety of the system 20 in that if one of the cords 54 were to break, one cord 54 would still remain attached to the cage 56.

Figure 4:
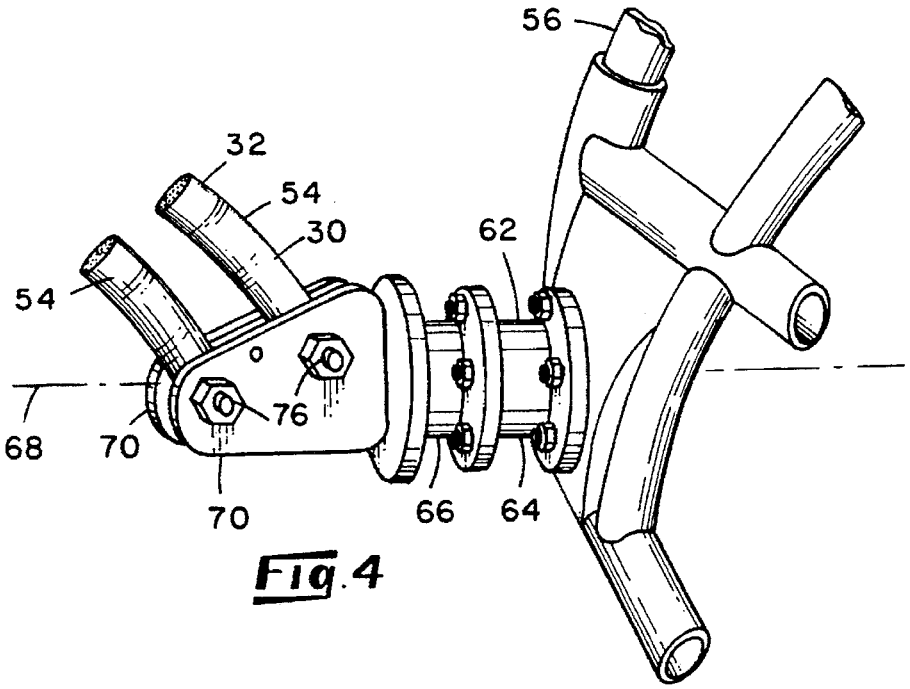
FIG. 4 is a perspective view of a fragment of the chair assembly of the FIG. 1 system as seen generally from behind in FIG. 1.
Figure 5:
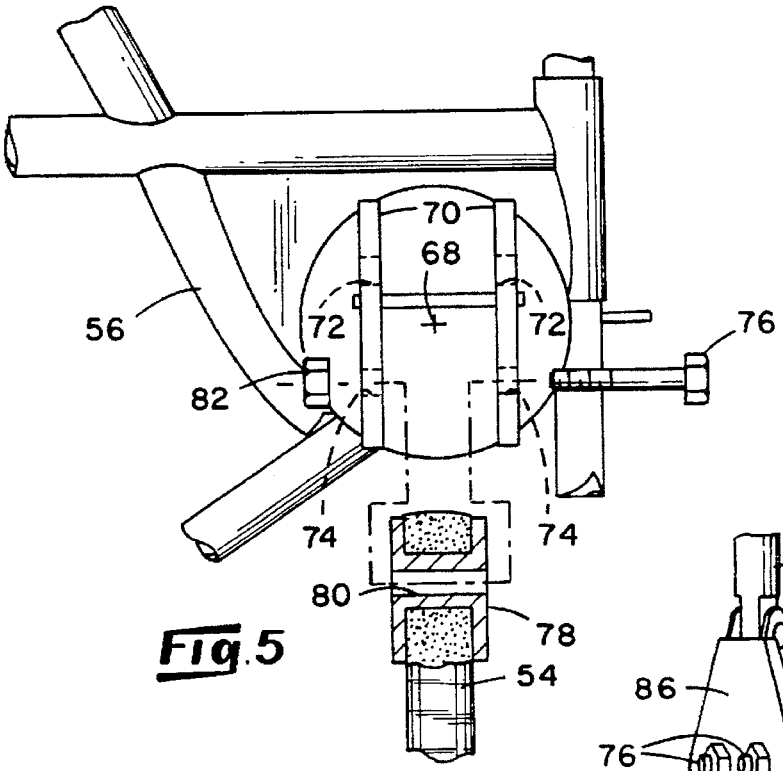
FIG. 5 is a side elevational view of the FIG. 4 fragment as seen generally from the left in FIG. 4 and shown exploded.

To accommodate the securement of each bungee cord 54 to the chair assembly 22 and with reference to FIGS. 4 and 5, there is provided on each side of the chair assembly 22 a bearing assembly 62 having a spindle-carrying inner portion 64 secured in a stationary condition with respect to the cage 56 and a hub-carrying outer portion 66 to which the bungee cord 54 is secured. Each outer portion 66 is rotatably fixed to the inner portion 64 to accommodate rotation of the outer portion 66 relative thereto about a pivot axis 68. During the operation of the ride system 20 during which the cage 56 may be expected to roll or be turned upside down, the bearing assemblies 62 prevent the bungee cords 54 from exposure to undue strain which could otherwise result from the development of kinks along the length of the cords 54.

Fixedly secured to the outer portion 66 of each bearing assembly 62 is a pair of somewhat triangular-shaped plates 70 which are arranged in spaced relationship with one another and define two sets of aligned openings 72, 74 (best shown in FIG. 5) for receiving bolts 76. In addition, each end of each bungee cord 54 is wrapped about a spool 78 having a central through-opening 80 for accepting the shank of a bolt 76. To fasten each cord 54 to the plates 70, the cord 54 is positioned between the plates 70 so that the through-opening 80 of the spool 78 is aligned with a corresponding set of openings 72 or 74, and then a bolt 76 is directed through the aligned openings and suitably secured to the plates 70 with a nut 82 threaded upon the end of the bolt 76 opposite the bolt head.

Figure 6:
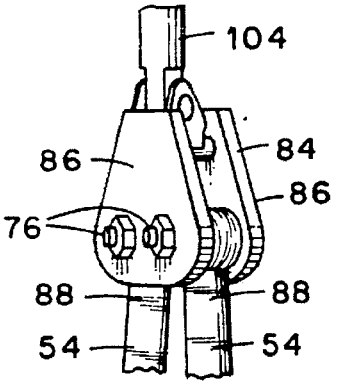
FIG. 6 is a perspective view of another fragment of the FIG. 1 system as seen generally from the front in FIG. 1.

With reference to FIG. 6, the end of each bungee cord 54 opposite the plates 70 is secured to a plate assembly 84 including a pair of plates 86 which are maintained in a spaced relationship with one another and which are securely joined to the end of a corresponding tensioning cable 34. As is the case with the plates 70, the plates 86 of the plate assembly 84 are provided with a two sets of aligned openings, and each corresponding bungee cord end, indicated 88, along with the spool about which the cord end is wrapped, is adapted to be received within the space defined between the plates 86. After positioning the spools of the bungee cord ends 88 between the plates 86 so that the through-openings of the spools are positioned in registry with a corresponding set of aligned openings provided in the plates 86, a bolt 76 is inserted through and secured within the aligned openings to thereby secure the bungee cord ends 88 to the plate assembly 84.

Figure 7:
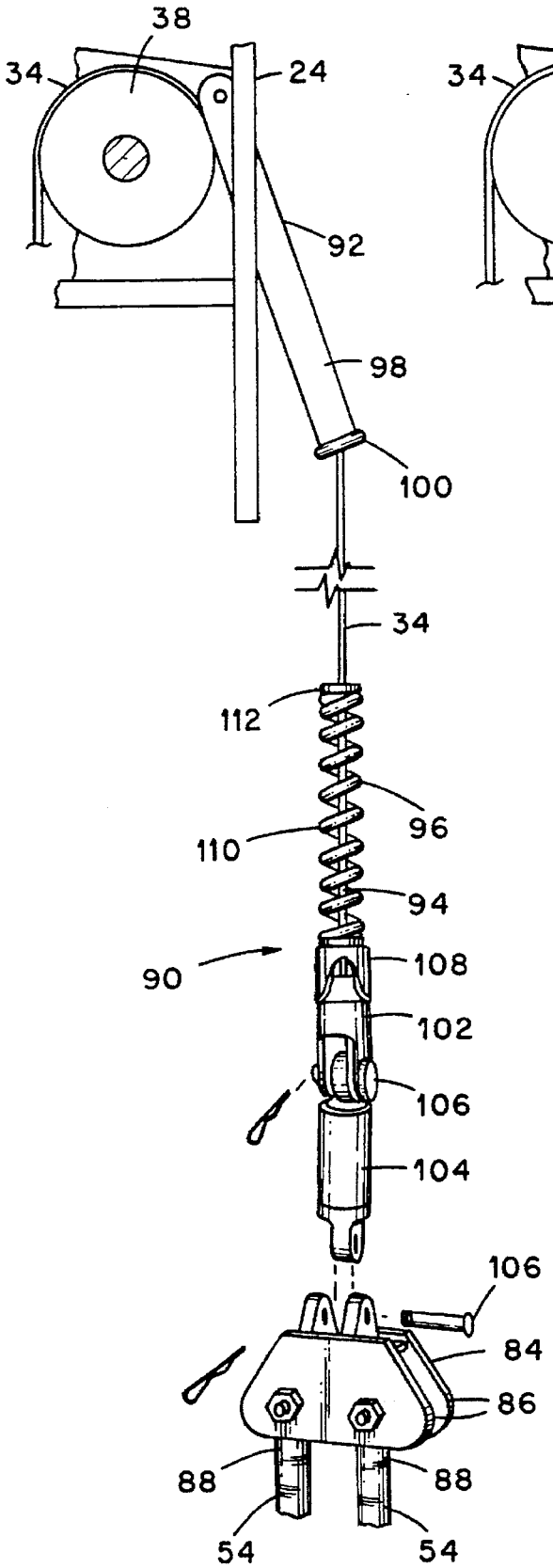
FIG. 7 is a front elevational view of still another fragment of the FIG. 1 system as seen generally from the front in FIG. 1 and shown exploded and shown partially cut-away.
Figure 8:
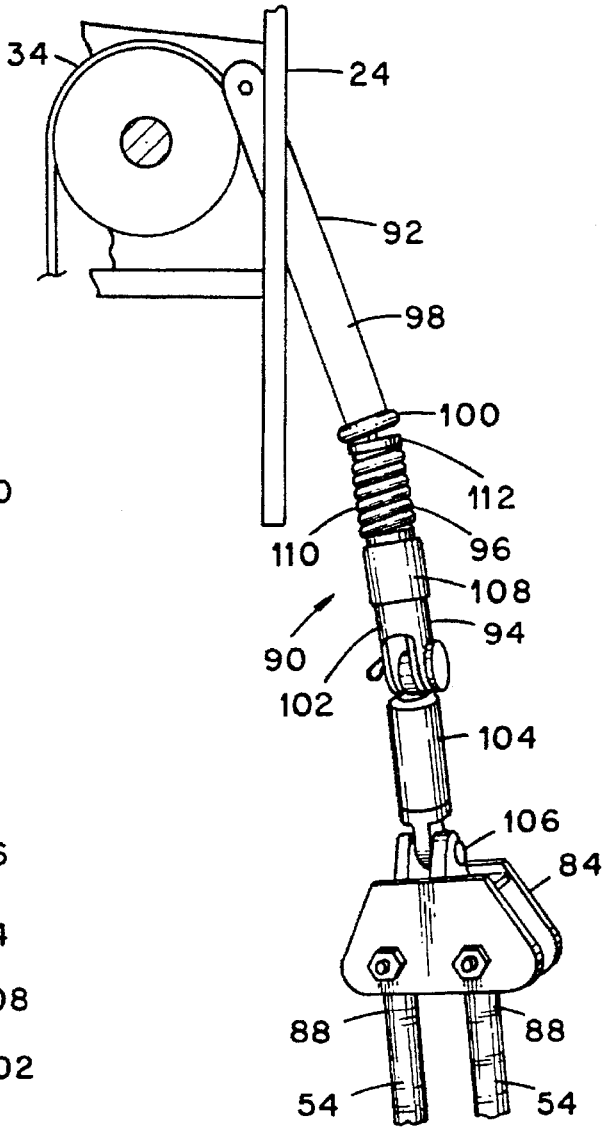
FIG. 8 is a view of the FIG. 7 fragment illustrating the condition of the various components thereof when the bungee cords are tensioned to a stretched condition.

With reference to FIGS. 7 and 8, the system 20 also includes safety spring means, generally indicated 90, associated with each tensioning cable 34 for reducing the shock on the cable 34 when the bungee cords 54 are extended to the fully stretched condition. In this connection, there is pivotally mounted on each of the first and second towers 24 and 26 a rooster-head assembly 92 through which the cable 34 is routed as it extends from the pulley 38 toward the chair assembly 22, and there is mounted upon the end, indicated 94, of the tensioning cable 34 a compression spring assembly 96. The rooster-head assembly 92 includes a conduit 98 which is pivotally mounted upon the tower 24 or 26 adjacent the pulley 38, and the cable 34 is routed through the conduit 98. As will be apparent herein, the conduit 98 has a distal end having a surface 100 for abutting an end of the spring assembly 96 during the tensioning of the bungee cord means 32 to a stretched condition.

Each cable end 94 terminates in a clevis member 102 to which the plate assembly 84 is connected (by way of a spacer member 104 and pins 106), and the safety spring means 90 includes a spring assembly 96 having a sleeve member 108 adjacent its lower end (as viewed in FIGS. 7 and 8) and a strong compression spring 110 attached atop the sleeve member 108 and arranged about the cable 34 so that the coils of the spring 110 encircle the cable 34. The sleeve member 108 is sized so as to prevent the clevis member 102 from passing therethrough, and the end of the spring 110 opposite the sleeve member 108 supports a flat washer-type member 112 having a central opening through which the cable 34 extends. Prior to the tensioning of the bungee cord means 32 toward a stretched condition, the spring assembly 96 is carried atop the clevis member 102 of the cable end 94 so that the spring 110 is in an extended condition as illustrated in FIG. 7.

During the tensioning of the bungee cord means 32 and after winding the cable 34 about the spool 36 (FIG. 1) by a sufficient amount, the washer-type member 112 abuts the distal end surface 100 of the conduit 98 of the rooster-head assembly 92 so that continued winding of the cable 34 about the spool 36 pulls the clevis member 102 closer to the distal end surface 100 to effect a compression of the spring 110 toward the compressed condition illustrated in FIG. 8. As the bungee cords 54 are being tensioned to a stretched condition, an operator of the system 20 watches the ends 94 of the tension cables 34 and deactuates the motors 39 when he sees the spring assembly 96 engage the rooster-head assembly 92. Preferably, the compression spring 110 of each spring assembly 96 will be in a partially-compressed state when the movement of the cable end 94 is halted so that tension is maintained on each cable 34 between the spool 36 and the cable end 94 during the period following the release of the chair assembly 22 from the pull cable 40. The relatively long length of the spring assembly 96 provides the operator a relatively lengthy window of opportunity to halt the movement of the cable ends 94 before exposing the system components to harm, and the action, i.e. the compression, of the spring 110 between the conduit 98 and the cable end 94 cushions what could otherwise be a relatively hard impact between the rooster-head assembly 92 and the cable end 94.

After winding the tensioning cables 34 to the condition depicted in FIG. 8 and after winding the pull cable 40 so that the chair assembly 22 is positioned adjacent the position illustrated in FIG. 2, the bungee cord means 32 are fully stretched for the intended purpose of throwing the chair assembly 22 through the air. Upon subsequent release of the chair assembly 22 from the pull cable 40 (thereby permitting the bungee cord means 32 to throw the chair assembly 22 through the air), the cable 34 remains anchored about the spool 36 while the cable 34 attempts to retract in length toward a relaxed condition. However, the engagement between the rooster-head assembly 92 and the compression spring 96 maintain the cable 34 in a taut condition as the chair assembly 22 is being thrown through the air and dampens any lengthwise oscillations of the cable 34 which may otherwise result as the pull exerted upon the cable 34 by way of the stretched bungee cord means 32 is suddenly released. Thus, the safety spring means 90 reduce the lengthwise oscillations experienced by the cable 34 in this manner and is further advantageous in this respect.

Figure 9:
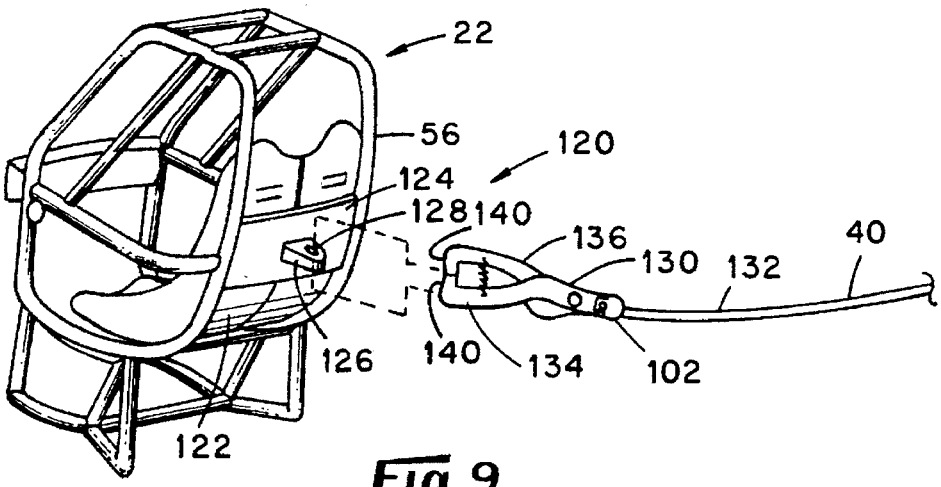
FIG. 9 is a perspective view of yet another fragment of the FIG. 1 system illustrating the means by which the back of the chair assembly is connected to one of the cables of the FIG. 1 system.

With reference to FIG. 9, the system 20 also includes means, generally indicated 120, for releasably securing the pull cable 40 to the back of the chair assembly 22. In this connection, the chair assembly 22 includes a plate 122 affixed, i.e. welded, to the tubular members of the cage 56 so as to extend across the back thereof and so that one face, indicated 124 of the plate 122, faces rearwardly of the cage 56. Welded to the face 124 of the plate 122 is a lug 126 having a through-opening 128 having a longitudinal axis which is arranged substantially vertically as shown in FIG. 9. Although the securing means 120 may take any of a number of forms, the securing means 120 of the depicted system 20 includes a pincer-like mechanism 130 secured to the end, indicated 132, of the pull cable 40 by way of the clevis member 102 associated with the cable end 132. The pincer-like mechanism 130 includes a pair of arms 134, 136 which are pivotally connected to one another with a pin 138. Each arm 134 or 136 includes a forward portion which terminates in a pin-like finger section 140 which opposes the pin-like finger section 140 of the other arm 134 or 136 of the mechanism 130. The surfaces of the finger sections 140 abut one another and are continually biased toward an abutting relationship by means of a tension spring 142 joined so as to act between the mechanism arms 134 and 136.

To attach the mechanism 130 to the cage 56, the forward portions of the arms 134, 136 are spread apart (as with a bar or some other suitable prying tool) to arrange the finger sections 140 of the arms 134, 136 in a spaced relationship. With the finger sections 140 arranged in a spaced relationship, they are then manipulated into registry with the upwardly and downwardly-opening ends of the through-opening 128 of the lug 126, and the finger sections 140 are thereafter permitted to return into abutting relationship with one another through the through-opening 128 by way of the tension spring 142 so that the mechanism 130 is secured to the lug 126 by way of the finger sections 140. With the mechanism 130 secured to the lug 126 in the foregoing manner, the pull cable 40 is secured to the cage 56.

Figure 10:
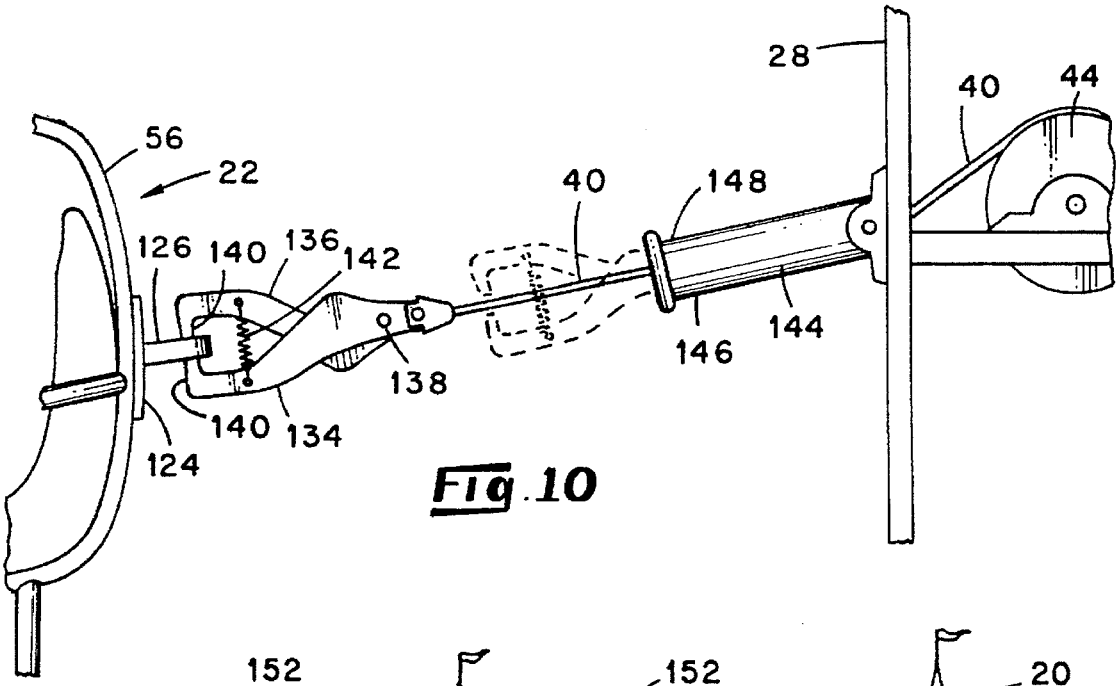
FIG. 10 is a side elevational view of a portion of the FIG. 9 fragment depicting the relationship of various components thereof at preselected stages of operation of the FIG. 1 system.

For releasing the cage 56 from the pull cable 40 at a preselected stage of the ride, there is associated with the third tower 28 a rooster-head assembly 144 having a conduit 146 through which the pull cable 40 is routed. One end of the conduit 146 is pivotally connected to the framework of the tower 28 while the other end of the conduit 146 terminates in a flared end portion 148 which opens along the length of the cable 40. When the pull cable 40 is wound about the corresponding spool 42 by an amount sufficient to pull the back of the cage 56 adjacent the tower 28, the rearward end portions of the mechanism arms 134, 136 begin to be accepted by the flared end portion 148 of the conduit 146. By continuing to pull the mechanism arms 134, 136 into the conduit 146, the flared end portion 148 of the conduit 146 slidably engages the surfaces of the rearward portions of the arms 134, 136 (as the conduit 146 and rearward portions of the arms 134, 136 act as cam and cam follower) to force the finger sections 140 apart, as illustrated in phantom in FIG. 10, and thereby release the cage 56 from the cable 40. Upon release of the cage 56 from the pull cable 40 while the chair assembly 22 is disposed adjacent the upper portion of the third tower 28, the bungee cord means 32 are permitted to throw the cage 56 through the air, and the operator of the system 20 de-actuates the motor 46 when he sees that the cage 56 has been released from the cable 40. It follows that the aforedescribed mechanism 130 is automatically released from the cable 40 when the cage 56 is pulled to a location disposed adjacent the upper end of the third tower 28.

For return of the release mechanism 130 to the chair assembly 22 for re-attachment thereto following a ride, there is provided a guide cable 160 (best shown in FIG. 3) extending between the ground and the third tower 28 for guiding the return of the release mechanism 130 following its release from the chair assembly 22. In particular, the guide cable 160 is anchored at one of its ends to the ground at a position adjacent the loading zone, indicated 150 in FIG. 2, located about midway between the bases of the first and second towers 24 and 26 and is anchored at the other of its ends to the upper end of the third tower 28 at a location immediately below the conduit 146. A tether line 162 is joined at one end to the release mechanism 130 and has a loop 164 at its other end which is looped about the guide cable 160 so that upon release of the mechanism 130 from the chair assembly 22, the release mechanism 130, along with optional weights added thereto, are permitted to gravitationally return to the loading zone 150 as the loop 164 of the tether 162 is permitted to slide along the length of the guide cable 160. It follows that the tether 162 (by way of its loop 164) is permitted to slide upwardly along the length of the guide cable 160 as the chair assembly 22 is pulled from the loading zone 150 by way of the pull cable 40.

In preparation of the ride system 20 for use, the release mechanism 130 is secured to the back of the chair assembly 22 by way of the lug 126, and the chair assembly 22 is positioned upon the ground at the loading zone 150 (FIG. 2). With the chair assembly 22 positioned at the loading zone 150, passengers can climb into the cage 56 and are secured within the seats 58 with the five-point harness assemblies 60. In addition and as illustrated in FIG. 1, the tensioning cables 34 have been unwound to an extent needed to permit the bungee cords 54 to assume a relaxed, undeformed condition as illustrated in FIG. 1, and the pull cable 40 is unwound to a lengthened condition, as illustrated in FIG. 3, at which the lug 126 can be reached by the release mechanism 130. After loading and securing the passengers within the chair assembly 22, the motors 39 and 46 are simultaneously actuated so that the tensioning cables 34 and the pull cable 40 begin to be wound about the corresponding spool 36 or 42 to raise the ends 88 of the bungee cords 54 and pull upon the back of the chair assembly 22. Such movement of the cables 34 and 40 effect a lifting of the chair assembly 22 from the loading zone 150 to an elevated position disposed between the towers 24, 26 and 28.

As the chair assembly 22 is lifted in the depicted system 20, the ends 94 of the tensioning cables 34 reach the rooster-head assemblies 92 adjacent the upper ends of the first and second towers 24, 26 before the end 132 of the pull cable 40 reaches the rooster-head assembly 144 adjacent the upper end of the third tower 28. The motors 39 are switched off when the ends 132 of the tensioning cables 34 reach the rooster-head assembly 92 but the motor 46 continues to wind the pull cable 40 about the spool 42 to both stretch the bungee cord 54 to the stretched condition illustrated in FIG. 3 and to (eventually) effect the release of the chair assembly 22 from the pull cable 40 by way of the release means 20. It will be understood that immediately prior to the release of the chair assembly 22 from the pull cable 40, the chair assembly 22 is disposed adjacent the upper end of the third tower 28 as shown in solid lines in FIG. 3.

Figure 11:
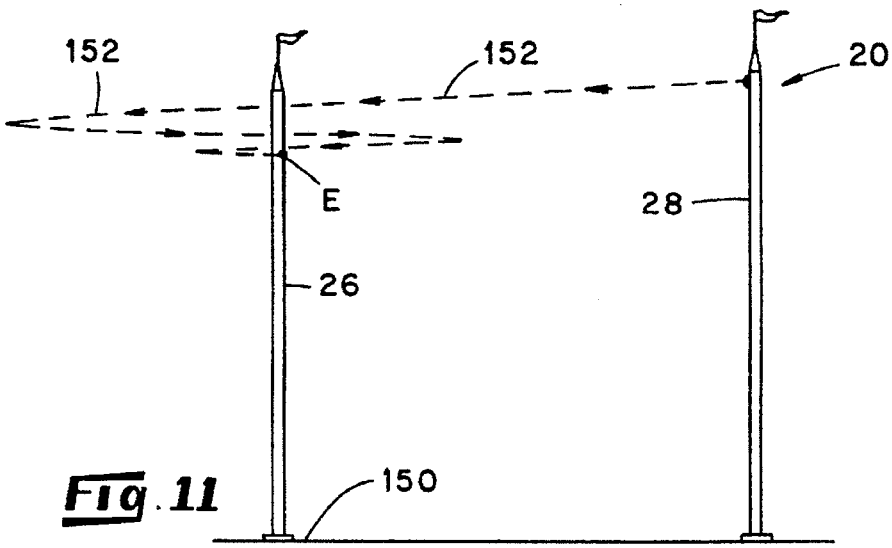
FIG. 11 is a side elevational view of the FIG. 1 system schematically illustrating the general path of the chair assembly following its release from the elevated position illustrated in FIGS. 2 and 3.

Upon release of the chair assembly 22 from the pull cable 40, the stretched bungee cords 54 throw the chair assembly 22 in a sling shot manner along a substantially horizontal path extending away from the upper portion of the third tower 28 and disposed about midway between the first and second towers 24 and 26. The movement, and more particularly the acceleration, of the chair assembly 22 away from the third tower 28 upon release from the pull cable 40 is so rapid that in comparison to the horizontal distance traveled by the chair assembly 22 during the first pass of the chair assembly 22 between the first and second tower 24, 26, the vertical drop of the chair assembly 22 during this first pass is relatively small. The chair assembly 22 is thereafter repeatedly moved rearwardly and forwardly relative to the first and second towers 24, 26 (and toward and away from the third tower 28) in a combined bouncing and swinging motion before the bungee cords 54 attain a fully relaxed condition. The path, as viewed from one side, traveled by the chair assembly 22 following its release from the pull cable 40 is indicated 152 in FIG. 11 and resembles somewhat of a tight sinusoidal pattern wherein the waves of the pattern converge toward a position, indicated E in FIG. 11, of equilibrium located between the first and second towers 24, 26 and elevated high above the loading zone 150. When the rearward and forward movement of the chair assembly 22 finally comes to a halt, the chair assembly 22 is lowered to the loading zone 150 (by unwinding the tensioning cables 34). The release mechanism 130, which is gravitationally guided downwardly along the guide cable 160 following release of the mechanism 130 from the back of the chair assembly 22 to the loading zone 150, is subsequently reattached to the back of the chair assembly 40 in preparation for a subsequent ride.

It follows from the foregoing that an amusement ride system 20 has been described which, by way of its three towers 24, 26, 28, bungee cords 54 and pull cable 40, is capable of throwing an individual (or a passenger seated within the chair assembly 22) through the air from a position adjacent the tower 28 along a substantially horizontal path. The tensioning of the bungee cords 54 to a ready-to-throw condition is effected by the winding of the tensioning cables 34 in conjunction with the winding of the pull cable 40 so that the chair assembly 22 is pulled to a position adjacent the upper end of the third tower 28. In addition, the use of two bungee cords 54, rather than one, on each side of the chair assembly 22 enables the diameter of the cords 54 to be relatively small in comparison to that of a single cord and more flexible than that of a single cord. In addition, a safety spring assembly has been described which maintains the tensioning cables 34 in a taut condition as the chair assembly 22 is being thrown through the air, and a release means 120 has been described which automatically releases the chair assembly 22 from the pull cable 40 upon movement of the chair assembly 22 to a preselected position relative to the tower 28.

Exemplary dimensions of the amusement ride system 20 are as follows: The height of each pulley 38 or 44 (as measured from the ground) is about 70 feet, the distance between the first and second towers 24 and 26 is about 50 feet, and the distance between the third tower 28 and a line drawn between the first and second towers 24 and 26 (corresponding to the location of the loading zone 150) is about 70 feet.

It will be understood that numerous modifications and substitutions can be had to the aforedescribed embodiment without departing from the spirit of the invention. For example, although the elevated supports from which the bungee cords means 32 are pulled and the pull cable 40 is tensioned are shown and described as towers, the elevated supports could be provided by alternative means, such as the sides of buildings. Accordingly, the aforedescribed embodiment is intended for the purpose of illustration and not as limitation.

I claim:

1. An amusement ride system comprising:

a chair assembly for supporting an individual during the course of a ride;

means providing first, second and third elevated supports arranged in a spaced and substantially triangular relationship;

the chair assembly being arranged between the first, second, and third elevated supports;

first bungee cord means having two opposite ends wherein one end of the first bungee cord means is joined to the chair assembly;

second bungee cord means having two opposite ends wherein one end of the second bungee cord means is joined to the chair assembly;

means associated with the first and second elevated supports for pulling upon the ends of the first and second bungee cord means opposite the one ends thereof to which the first and second bungee cord means are joined for tensioning the first and second bungee cord means to a stretched condition;

a pull cable releasably joined to the chair assembly;

means for tensioning the pull cable between the chair assembly and the third elevated support so that by pulling the bungee cord means to a stretched condition and tensioning the pull cable, the chair assembly is lifted by the bungee cord means and the pull cable toward a preselected position between the elevated supports at which the first bungee cord means are arranged in a stretched condition between the chair assembly and the first elevated support and the second bungee cord means are arranged in a stretched condition between the chair assembly and the second elevated support; and means for releasing the pull cable from the chair assembly when the chair assembly is positioned in the preselected position so that the first and second bungee cord means are permitted to throw the chair assembly along a path extending from the third elevated support and between the first and second elevated supports.

2. The system as defined in claim 1 wherein each of the first and second bungee cord means include a pair of bungee cords which extend between the chair assembly and the pulling means.

3. The system as defined in claim 1 wherein the means for pulling upon the ends of the first and second bungee cord means includes a pair of spools mounted for rotation relative to the elevated supports, a first elongated cable having a first end which is attached to the end of the first bungee cord means opposite the one end thereof and a second end which is attached to one of the spools, a second elongated cable having a first end which is attached to the end of the second bungee cord means opposite the one end thereof and a second end which is attached to the other of the spools, and means for winding each of the elongated cables about its corresponding spool.

4. The system as defined in claim 3 further including a first conduit mounted adjacent the first elevated support through which the first elongated cable is routed as it extends between the first bungee cord means and said one spool, a second conduit mounted adjacent the second elevated support through which the second elongated cable is routed as it extends between the second bungee cord means and said other spool, a first compression spring which is interposed between the first end of the first elongated cable and the first conduit, and a second compression spring which is interposed between the first end of the second elongated cable and the second conduit.

5. The system as defined in claim 1 wherein the means for releasing the pull cable from the chair assembly includes means for automatically releasing the pull cable from the chair assembly upon movement of the chair assembly into the preselected position.

6. The system as defined in claim 1 wherein the first, second and third elevated supports are positioned at about the same horizontal elevation so that the throwing of the chair assembly through the air by the first and second bungee cord means from the preselected position effects a throwing of the chair assembly along a substantially horizontal path.

7. An amusement ride system comprising:

a chair assembly within which an occupant is seated during the course of a ride performed with the system and wherein the chair assembly includes two opposite sides and a back;

first, second and third upstanding towers fixedly secured to the ground in a spaced and substantially triangular relationship, and each tower having an upper portion;

the chair assembly being arranged between the towers so that the first and second towers are disposed to the sides of the chair assembly and so that the back of the chair assembly generally faces the third tower;

first bungee cord means joined to one side of the chair assembly and having an end which extends toward the upper portion of the first tower;

second bungee cord means joined to the side of the chair assembly opposite said one side and having an end which extends toward the upper portion of the second tower;

means associated with the extending end of the first bungee cord means for tensioning the first bungee cord means between the chair assembly and the upper portion of the first tower to a stretched condition and means associated with the extending end of the second bungee cord means for tensioning the second bungee cord means between the chair assembly and the upper portion of the second tower to a stretched condition;

a pull cable releasably joined to the back of the chair assembly and extending toward the upper portion of the third tower;

means for tensioning the pull cable by way of the upper portion of the third tower so that by pulling the first and second bungee cord means to a stretched condition and tensioning the pull cable, the chair assembly is lifted by the bungee cord means and the pull cable to a elevated position adjacent the upper portion of the third tower at which each of the first and second bungee cord means is arranged in a stretched condition between the chair assembly and the upper portion of its corresponding tower; and means for releasing the cable from the back of the chair assembly when the chair assembly is positioned in said elevated position so that the first and second bungee cord means are permitted to throw the chair assembly along a path extending from the third tower and between the first and second towers.

8. The system as defined in claim 7 wherein each of the first and second bungee cord means include a pair of bungee cords which extend between the chair assembly and the corresponding means for tensioning the first and second bungee cord means.

9. The system as defined in claim 7 wherein the means for tensioning the first and second bungee cord means includes a pair of spools which are mounted for rotation relative to the first and second towers, a first elongated cable having a first end which is attached to the end of the first bungee cord means opposite the one end thereof and a second end which is attached to one of the spools, a second elongated cable having a first end which is attached to the end of the second bungee cord means opposite the one end thereof and a second end which is attached to the other of the spools, and means for winding each of the elongated cables about its corresponding spool.

10. The system as defined in claim 9 further including a first conduit mounted adjacent the upper portion of the first tower through which the first elongated cable is routed as it extends between the first bungee cord means and said one spool, a second conduit mounted adjacent the upper portion of the second tower through which the second elongated cable is routed as it extends between the second bungee cord means and said other spool, a first compression spring which is interposed between the first end of the first elongated cable and the first conduit, and a second compression spring which is interposed between the first end of the second elongated cable and the second conduit.

11. The system as defined in claim 7 wherein the means for releasing the pull cable from the chair assembly includes means for automatically releasing the pull cable from the chair assembly upon movement of the chair assembly into the preselected position.

12. The system as defined in claim 7 wherein the upper portions of the first, second and third towers are positioned at about the same horizontal elevation so that the throwing of the chair assembly through the air by the first and second bungee cord means from said elevated position effects a throwing of the chair assembly along a substantially horizontal path.

13. An amusement ride system comprising:

a chair assembly within which an occupant is seated during the course of a ride performed with the system and wherein the chair assembly includes two opposite sides and a back;

first, second and third upstanding towers fixedly secured to the ground in a spaced and substantially triangular relationship, and each tower having an upper portion;

the chair assembly being arranged between the towers so that the first and second towers are disposed to the sides of the chair assembly and so that the back of the chair assembly generally faces the third tower;

first bungee cord means having two opposite ends wherein one end of the bungee cord means is joined to one side of the chair assembly and the other end of the bungee cord means extends toward the upper portion of the first tower;

second bungee cord means having two opposite ends wherein one end of the bungee cord means is joined to the side of the chair assembly opposite said one side and the other end of the bungee cord means extends toward the upper portion of the second tower;

means associated with the upper portion of the first tower and joined to the extending end of the first bungee cord means for tensioning the first bungee cord means between the chair assembly and the upper portion of the first tower to a stretched condition and means associated with the upper portion of the second tower and joined to the extending end of the second bungee cord means for tensioning the second bungee cord means between the chair assembly and the upper portion of the second tower to a stretched condition;

a pull cable extending from the upper portion of the third tower and releasably joined to the back of the chair assembly;

means for tensioning the pull cable from the upper portion of the third tower so that by tensioning the first and second bungee cord means to a stretched condition and tensioning the pull cable, the chair assembly is lifted by the bungee cord means and the pull cable to an elevated position adjacent the upper portion of the third tower at which each of the first and second bungee cord means is arranged in a stretched condition between the chair assembly and the upper portion of its corresponding tower; and means for releasing the cable from the back of the chair assembly when the chair assembly is positioned in said elevated position so that the first and second bungee cord means are permitted to throw the chair assembly along a path extending from the third tower and between the first and second towers.

14. The system as defined in claim 13 wherein each of the first and second bungee cord means include a pair of bungee cords which extend between the chair assembly and the corresponding means for tensioning the first and second bungee cord means.

15. The system as defined in claim 13 wherein the upper portions of the first, second and third towers are positioned at about the same horizontal elevation so that the throwing of the chair assembly through the air by the first and second bungee cord means from said elevated position effects a throwing of the chair assembly along a substantially horizontal path.

* * * * *